US007891872B2

(12) United States Patent
Kuhnmuench

(10) Patent No.: US 7,891,872 B2
(45) Date of Patent: Feb. 22, 2011

(54) SECURE HOUSING FOR AN X-RAY APPARATUS WITH COMBINED PIVOTING AND SLIDING DOOR

(75) Inventor: Norbert Kuhnmuench, Pfinztal (DE)

(73) Assignee: Bruker AXS GmbH, Karlsruhe (DE)

( * ) Notice: Subject to any disclaimer, the term of this patent is extended or adjusted under 35 U.S.C. 154(b) by 29 days.

(21) Appl. No.: 12/385,822

(22) Filed: Apr. 21, 2009

(65) Prior Publication Data

US 2010/0111266 A1 May 6, 2010

(30) Foreign Application Priority Data

Apr. 25, 2008 (DE) ..... 10 2008 020 730

(51) Int. Cl.
*H01J 35/16* (2006.01)

(52) U.S. Cl. ..... 378/203

(58) Field of Classification Search ..... 378/203
See application file for complete search history.

(56) References Cited

U.S. PATENT DOCUMENTS

| | | | | |
|---|---|---|---|---|
| 1,175,450 | A | 3/1916 | Hogan | 378/190 |
| 6,233,307 | B1 | 5/2001 | Golenhofen | 378/45 |
| 6,485,176 | B1 * | 11/2002 | Chen et al. | 378/193 |
| 2007/0068080 | A1 * | 3/2007 | Vigdorovich et al. | 49/130 |

FOREIGN PATENT DOCUMENTS

| | | |
|---|---|---|
| EP | 0 955 539 | 11/1999 |
| EP | 1 477 991 | 11/2004 |
| GB | 1 176915 | 1/1970 |

(Continued)

OTHER PUBLICATIONS

Broshure "D 5000", Bruker AXS, Karlsruhe, Germany (2008).

(Continued)

*Primary Examiner*—Courtney Thomas
(74) *Attorney, Agent, or Firm*—Paul Vincent

(57) ABSTRACT

A safety housing (1) for an X-ray apparatus, comprises a working chamber (2) which can accommodate X-ray apparatus protection elements (3*a*-3*c*, 5*a*, 5*b*; 21), in particular lead-containing walls and/or lead glass panes, which are impermeable to X-rays and which surround the working chamber (2) and at least one door (6*a*, 6*b*) for opening and closing an access (4) to the working chamber (2) of the safety housing (1), wherein the door (6*a*, 6*b*) has at least one door protection element (5*a*, 5*b*; 21), in particular a lead glass pane, which is impermeable to X-ray radiation, wherein the at least one door protection element (5*a*, 5*b*; 21) can completely cover the access to the working chamber (2), and wherein the door (6*a*, 6*b*) can be pivoted about an axis S relative to a main frame (9) of the safety housing (1). At least one door protection element (5*a*-5*b*) of the door (6*a*, 6*b*) is formed on one sliding door (10*a*, 10*b*), the sliding door (10*a*, 10*b*) being disposed on a casement (7*a*, 7*b*) of the door (6*a*, 6*b*) such that it can be displaced in a direction V, and the casement (7*a*, 7*b*) of the door (6*a*, 6*b*) can be pivoted about the axis S relative to the main frame (9). The amount of space that is required in front of the access to the working chamber is thereby reduced.

26 Claims, 8 Drawing Sheets

FOREIGN PATENT DOCUMENTS

| | | |
|---|---|---|
| GB | 2 060 330 | 4/1981 |
| JP | 05 066 293 | 3/1993 |
| JP | 09 148091 | 6/1997 |

OTHER PUBLICATIONS

Sales Broshure "D 5000 X-Ray Diffractometer", Siemens AG, Karlsruhe, Germany, (1997).

Sales Broshure "Diffractive Solutions D 5005 with DIFFRAC$^{plus}$" Siemens Analytical X-Ray Systems, Madison, WI, (1997).

Sales Sheet "Bruker AXS D8" Bruker AXS GmbH, Karlsruhe, Germany, (2007).

* cited by examiner

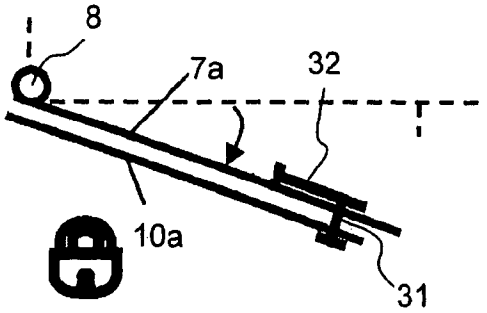
Fig. 3d
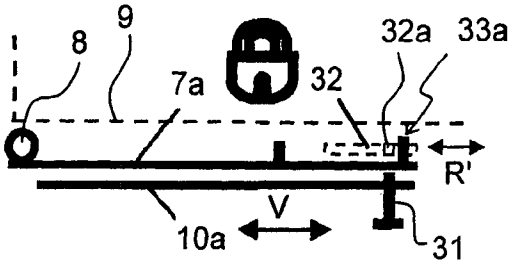
Fig. 3e
Fig. 3a
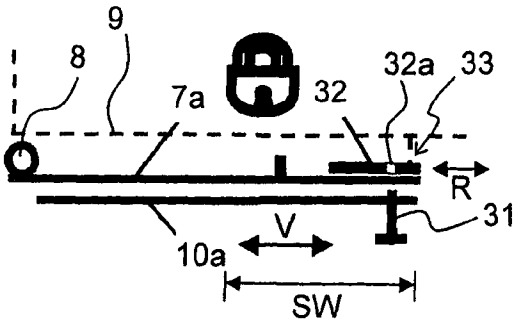
Fig. 3b
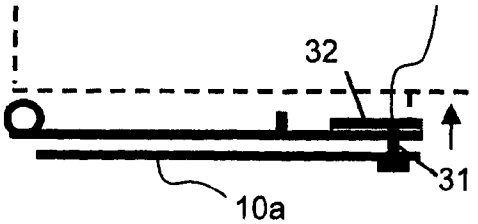
Fig. 3c
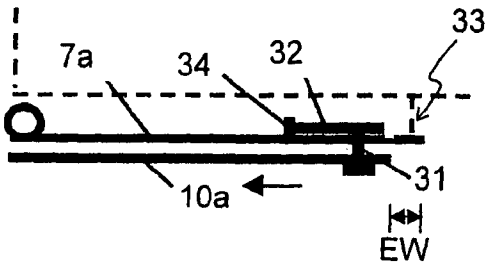

SECURE HOUSING FOR AN X-RAY APPARATUS WITH COMBINED PIVOTING AND SLIDING DOOR

This application claims Paris Convention priority of DE 10 2008 020 730.6 filed Apr. 25, 2008 the complete disclosure of which is hereby incorporated by reference.

BACKGROUND OF THE INVENTION

The invention concerns a safety housing for an X-ray apparatus, comprising

- a working chamber which can accommodate an X-ray apparatus;
- protection elements, in particular lead-containing walls and/or lead glass panes, which are impermeable to X-rays and surround the working chamber;
- at least one door for opening and closing an access to the working chamber of the safety housing, wherein the door has at least one door protection element, in particular a lead glass pane, which is impermeable to X-ray radiation, wherein the at least one door protection element can completely cover the access to the working chamber, and wherein the door can be pivoted about an axis S relative to a main frame of the safety housing.

A safety housing of this type is used e.g. in the commercially distributed X-ray spectrometer "D5000" of Bruker AXS GmbH, Karlsruhe.

X-ray radiation is used in a plurality of ways in diagnostic and analytical methods. X-ray diffractometry e.g. is a powerful method of instrumental analysis, which obtains information about the atomic structure, in particular the crystal structure, of a sample through X-ray diffraction on the sample.

The application of X-rays is generally dangerous for human beings. Exposition to intensive X-ray radiation can directly lead to human tissue burns and tumors at that location. In the long term, even small doses of X-ray radiation can have a cancerous effect on the overall organism. For this reason, X-ray radiation is maximally shielded during application.

X-ray diffractometers and other X-ray apparatus are therefore usually operated in X-ray impermeable safety housings (protective housings). The safety housing is closed during operation, but must be accessible for manipulating the X-ray apparatus. The safety housing of an X-ray diffractometer must e.g. be opened in order to change the sample.

Folding doors are widely used for this purpose. The folding door of a protection housing is normally pivotable about a vertical axis. The folding door covers the access to the working chamber during operation of the X-ray apparatus and is opened in order to change the sample. The folding door is typically large enough in order to move a fully mounted X-ray apparatus into or out of the working chamber. Due to the size of the door, a relatively large amount of space must be kept free in front of the access to be able to open the folding door.

In scientific laboratories, it is often necessary to accommodate and operate a plurality of devices within a small space, i.e. there is a constant shortage of space. Working with different devices should be possible without mutual, in particular spatial, obstruction.

The protection housing of D5000 has a large folding door which covers the entire access to the working chamber, wherein a second smaller folding door is arranged in the large folding door. For changing the sample, it is sufficient to only open the second smaller folding door which requires only a relatively small amount of space in front of the access of the safety housing. For moving an assembled X-ray apparatus, the large folding door can be opened.

The access to the working chamber is moreover conventionally covered by a multifold door. This is the case with the X-ray spectrometer "D8" of Bruker AXS GmbH, Karlsruhe. Only part of the multifold door must be opened in order to change the sample, which also requires only a small amount of free space in front of the access.

It is the underlying object of the invention to further reduce the amount of free space that is required in front of the access to the working chamber of a safety housing of the above-mentioned kind.

SUMMARY OF THE INVENTION

This object is achieved by a safety housing of the above-mentioned type, which is characterized in that at least one door protection element of the door is formed on a sliding door, wherein the sliding door is disposed on a casement of the door such that it can be displaced in a direction V, and the casement of the door can be pivoted about the axis S relative to the main frame.

In accordance with the invention, a door having a pivoting function ("folding door") is provided with an additional sliding door function. Full access to the working chamber inside the protection housing can be provided via the pivotable casement that also pivots the sliding door. This is particularly useful for moving a mounted X-ray apparatus. If only minor manipulation of the X-ray apparatus is required (e.g. sample change or adjustment), the sliding door function may be used while the casement is closed. The sliding door does not, in particular, require any free space in front of the access, such that in case of space shortage in the laboratory, it is not necessary to maintain a minimum separation from any oppositely disposed further laboratory equipment during normal operation. If the sliding door is narrow in the direction of displacement V, it can be displaced only in front of the access without requiring any free space. If a wider sliding door is used, space is required only on the sides of the access which, however, generally only minimally impairs the options of using the space in the laboratory.

In accordance with the present invention, a protection element that is impermeable to X-ray radiation is hereby defined as one which weakens the X-ray intensity in transmission to 1/1000 or less, preferably by $10^{-6}$ times as measured at the wavelength of Cu-K$\alpha$ radiation. The access through the at least one door protection element can be completely covered, which means that any X-ray radiation that propagates from the working chamber in a straight line towards the access always intersects a door protection element.

In a preferred embodiment of the inventive safety housing, the access to the working chamber can be completely covered by the at least one door protection element of the sliding door, in particular, wherein the sliding door comprises exactly one door protection element. In other words, the door comprises only door protection elements of the sliding door. This facilitates the construction. Unobstructed view into the working chamber is ensured by providing one single lead glass pane as a single door protection element.

In another embodiment, the at least one door protection element of the sliding door extends in a direction perpendicularly to the direction V over the overall height of the access that can be closed by the door. In this fashion, the sliding door opens a maximum part of the access without requiring additional space in front of the access.

In one particularly preferred embodiment, at least one door protection element is rigidly mounted to the casement, and when the casement is closed and the sliding door is closed the door protection element(s) of the sliding door extend(s) over a first partial area of the access parallel to the direction V; and the door protection elements) mounted rigidly to the casement extend(s) over a second partial area of the access parallel to the direction V, wherein the first plus second partial areas cover the entire width of the access that can be closed by the door, in particular, wherein the first and the second partial areas overlap. In this embodiment, displaceable door protection elements of the sliding door and the door protection elements that are rigidly disposed in the casement supplement each other. When the sliding door is slid open, its door protection elements are preferably pushed over the door protection elements that are rigidly disposed in the casement, such that no free space is required next to the safety housing for opening the sliding door. In this embodiment, the surface portion of the displaceable door protection elements of the door can also be reduced in order to facilitate construction.

In another preferred further development of this embodiment, the first partial area extends approximately over half the width of the access parallel to the direction V when the casement and the sliding door are closed. The second partial area also extends over approximately half the width of the access (i.e. its other half). This opens the maximum portion of the access by opening the sliding door without requiring any free space next to the safety housing.

In another preferred embodiment, the door protection element(s) of the sliding door cover(s) the access to the working chamber in a border area of the access that is remote from the axis S, and the sliding door can be slid open from its closed position in the direction towards the axis S, when the sliding door and the casement are closed. This reduces the bearing forces that act on the suspensions (hinges, pivot joints) of the casement when the sliding door is opened. This is also facilitated by combined actuation of the casement and the sliding door by means of the same handle and operating element.

One particularly preferred embodiment of the inventive safety housing is characterized in that a latch is provided for locking and unlocking the casement in its closed state with respect to the main frame, and an operating element is provided on the sliding door, which can be moved together with the sliding door and can be changed between a first position and a second position, wherein, in the first position of the operating element, the operating element does not obstruct movement of the sliding door on the casement, and movement of the sliding door does not influence the position of the latch, and wherein, in the second position of the operating element, the operating element engages the latch or a carrier that is rigidly connected or hinged to the latch, such that, when the casement is closed, the latch is operated by moving the sliding door when the operating element is in the second position.

This embodiment provides simple and reliable operation of both the casement function (pivoting or folding open of the casement or the entire door) and also of the sliding frame function (moving the sliding door when the casement is closed). The sliding door has an operating element that is preferably integrated in a handle disposed on the sliding door. A human operator can change the operating element between the first and the second position (at least and preferably only when the casement is closed), e.g. by exerting pressure onto the operating element.

The operating element is in the first position in order to be able to apply the sliding door function. In this first position, the latch locks the casement such that it is held in the closed position. The sliding door can be moved relative to the casement by a manual lateral pulling action on the sliding door (or an associated handle) in order to open part of the access to the working chamber. The first position is the standard position for the operating element. The operating element is typically pretensioned in this first position.

In order to actuate the casement function, the operating element is changed into the second position. By manually laterally pulling the sliding door, the latch is operated and the sliding door is also moved with respect to the casement, but typically only within a narrow range ("unlocking path"). As soon as the latch is unlocked, the casement can be opened by pulling the sliding door to the front.

The inventive embodiment realizes the mechanical change between the two operating modes of the door mechanism in the simplest fashion (sliding door function and folding door function). Only one operating element is required to handle the sliding door (or an associated handle). Operation of the different operating modes at the same time is preferably mechanically prevented by locking and blocking mechanisms, i.e. when the sliding door is opened, the folding door cannot be unlocked, and when the casement is open, the sliding door cannot be opened. In particular, switching over of the operating element from the first position to the second position is preferably blocked when the sliding door is not closed.

In one particularly preferred further development of the above-mentioned embodiment, in the second position of the operating element, a latch position associated with the closed sliding door locks the casement and a locked position associated with a moved sliding door releases the casement. In this embodiment, it is sufficient to operate only one single safety locking per door of the safety housing for reliable operation. The safety lock only needs to check or ensure that the sliding door is closed, since in this case, the folding door is inevitably also locked.

In a preferred further development, the range of movement of the sliding door away from the closed position in the second position of the operating element is defined by a mechanical stop to an unlocking path EW which is shorter than the maximum sliding path SW of the sliding door in the first position of the operating element, in particular, wherein $EW \leqq 0.2*SW$, and in particular wherein $EW \leqq 5$ cm. The mechanical stop marks a sliding door position in which the latch is unlocked. Any further unnecessary and tedious movement of the sliding door is avoided. When the casement is displaced, the sliding door is largely closed such that the sliding door does not obstruct opening of the casement.

In a preferred further development, a locking mechanism is provided on the door, which blocks movement of the sliding door out of the position of movement of the sliding door on the mechanical stop when the casement is not closed and when the operating element is located in the second position, in particular, wherein a movable locking element is provided on the casement, which is pretensioned by a spring force into a locking position, in which it blocks the movement path of the operating element or of the latch or the carrier in the second position, and is moved out of the path of movement of the operating element or the latch or carrier in the second position when the casement is closed through interaction with a counter means that is rigidly formed on the main frame. This further development prevents operating errors of the door mechanism (in particular locking mechanism). The latch that is operated via the operating element remains in the unlocked position when the casement is opened in order to ensure smooth closing of the casement.

The sliding door is typically blocked on the mechanical stop through positive fit with a locking element that is movably disposed on the casement. This positive fit may be realized in the simplest form directly with the operating element, or with the latch or any carrier, which are respectively coupled to the operating element, thereby blocking the sliding door.

In another further development, a blocking mechanism is provided, which blocks a movement position of the sliding door on the mechanical stop. This also prevents operating errors of the door mechanism.

The blocking mechanism comprises e.g. a resilient ball in the casement, which engages in a recess on the latch to provide a resistance to movement of the sliding door, which is very easy to realize.

In another example, the blocking mechanism is provided by a third position of the operating element, in which a holding element of the casement blocks movement of the operating element, in particular, wherein the operating element is driven by the force of a spring from the second position into the third position and in particular, wherein the third position is formed between the first and the second position.

In a particularly preferred further development, a guidance is provided on the casement, which holds the operating element in the second position when the sliding door is moved out of its closed position, when the operating element is in the second position, and which only permits changing between the first and the second position when the sliding door is closed. This also prevents operation errors of the door mechanism (in particular locking mechanism). In particular, when the casement is open, the sliding door cannot be normally moved (i.e. as in the first position of the operating element).

In a preferred further development thereof, the guidance comprises an elongated hole through which the operating element (in the second position) can be guided on a narrowing of the operating element, and the elongated hole comprises a widening, where the operating element can be changed between a first and a second position when the sliding door is closed. The guidance can thereby be realized in a very simple mechanical fashion. The widening is typically provided at one end of the elongated hole.

In a preferred further development, the operating element comprises a pin that can be retracted and extended and which is pretensioned by a spring force into a retracted position which corresponds to the first position of the operating element, and which can be pushed by hand into an extended position which corresponds to the second position of the operating element. This simplifies utilization of the sliding door function that is normally used more often, and inadvertent activation of the folding door function is impeded.

In a preferred further development, the latch is disposed on the casement such that it can be displaced in a direction R, wherein the direction R and the direction V extend parallel to each other. Bearing and guiding the latch on the casement facilitates control of the operating element by the latch.

In an alternative fashion, the latch may also be disposed on the main frame such that it can be displaced in a direction R', wherein the direction R' and the direction V extend parallel to each other when the casement is closed. This facilitates a particularly robust design of the latch mechanism.

In one particularly preferred further development, an electronic safety module is provided on the main frame, which monitors closure of the access to the working chamber by the door during operation of an X-ray apparatus in the working chamber that releases X-rays during operation, wherein the safety module ensures the presence of an actuator in the safety module during operation of the X-ray apparatus, the actuator is rigidly mounted to the sliding door, and the safety module is designed such that the actuator can only be inserted into and removed from the safety module when the casement is closed by sliding the sliding door, wherein the position of the actuator introduced in the safety module corresponds to the closed position of the sliding door. The safety module ensures that X-ray radiation is only emitted when the actuator is present and/or that X-ray radiation is immediately switched off when the actuator is not present in the safety module and/or that the actuator in the safety module is blocked (thereby blocking opening the safety housing) when the X-ray radiation is switched on. Any opening of the door, i.e. of the casement or the sliding door, requires previous movement of the sliding door out of the closed position and thereby also of the actuator out of the safety module. For this reason, the access can be monitored by one single safety module. It should be noted that, in accordance with the invention, electronic actuation of the safety module, which is conventionally normally effected via a separate key, can be coupled to the use of the actuating element within the scope of the invention.

In a further preferred embodiment, the direction V, in which the sliding door can be moved with respect to the casement, extends perpendicularly to the axis S. This has turned out to be useful in practice, in particular, in that the overall motion for opening the casement is facilitated. The axis S typically extends in a vertical direction and the direction V extends in a horizontal direction.

In another preferred embodiment, the casement has the shape of a C, wherein the open side of the C-shaped frame faces away from the axis S.

This improves accessibility to the working chamber, in particular in case of a double-wing door arrangement.

Finally, in a particularly preferred embodiment, two adjacent doors are provided, wherein the two doors form two opposite wings of a double door, in particular, wherein the door protection elements of the two doors overlap. The partial areas of the accesses to the working chamber, which are opened in each case by sliding door functions, can then be used together.

The door (i.e. the door casement including sliding door) of an inventive safety housing is also preferably designed such that it can be unhinged, e.g. by means of hinges on the main frame, out of which the door can be lifted. This facilitates transport of the safety housing.

Further advantages of the invention can be extracted from the description and the drawing. The features mentioned above and below may be used in accordance with the invention either individually or collectively in arbitrary combination. The shown and described embodiments are not to be understood as exhaustive enumeration but have exemplary character for describing the invention.

The invention is illustrated in the drawing and is explained in more detail with reference to embodiments.

BRIEF DESCRIPTION OF THE DRAWING

FIGS. 3*a* to 3*d* show a schematic view of the process of changing the operating modes of a door of an inventive safety housing;

FIG. 3*e* shows a schematic view similar to FIG. 3*a* but with a latch that is disposed on the main frame;

DESCRIPTION OF THE PREFERRED EMBODIMENT

Figure 1B:
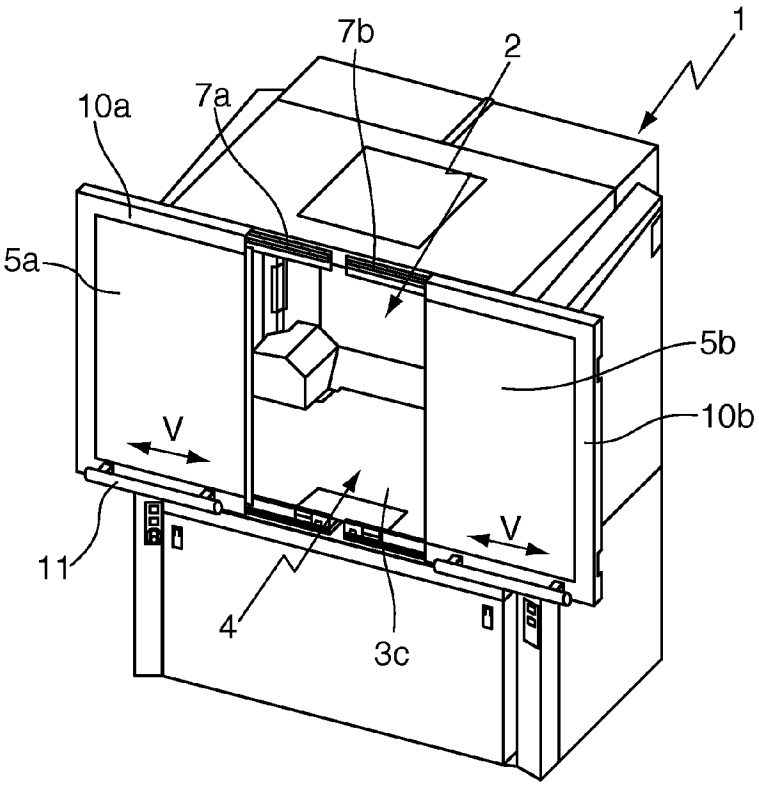
FIG. 1*b* shows the safety housing of FIG. 1*a* with closed casement and opened sliding door.
Figure 1A:
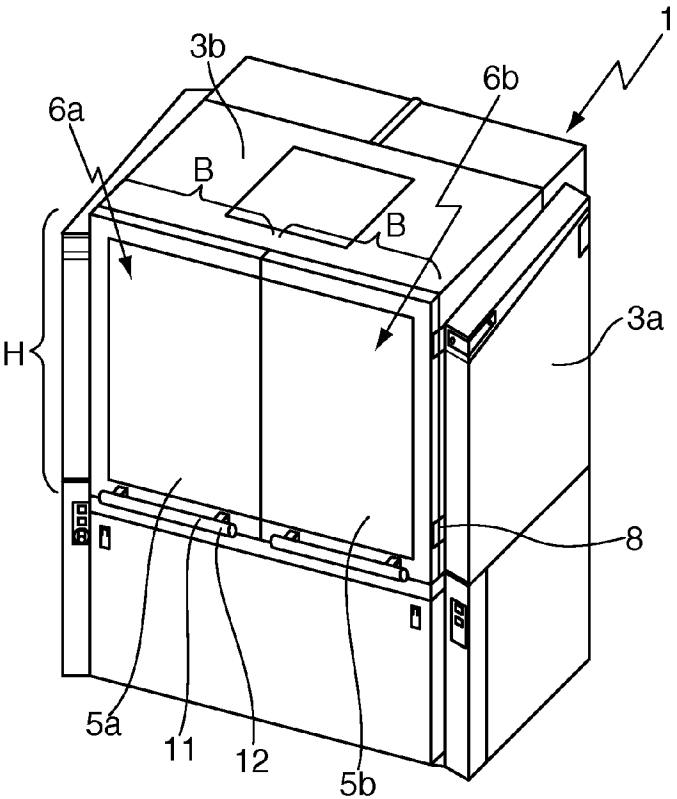
FIG. 1*a* shows a schematic perspective view of an embodiment of an inventive safety housing with two doors with closed casement and closed sliding door.
Figure 1C:
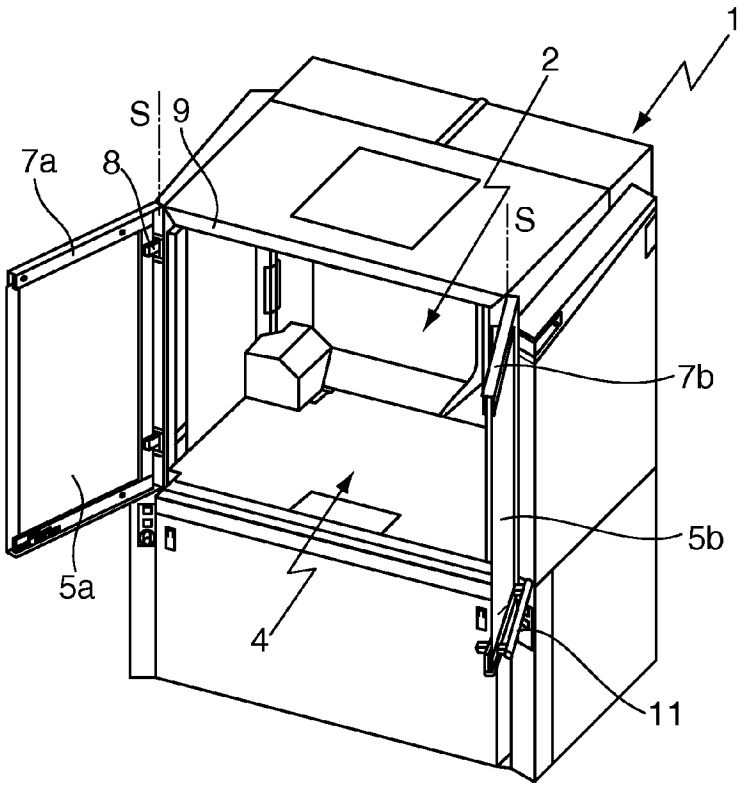
FIG. 1*c* shows the safety housing of FIG. 1*a* with open casement.

FIGS. 1*a* through 1*c* each show an inventive safety housing 1 for an X-ray apparatus, e.g. an X-ray diffractometer or an X-ray fluorescence analysis device or a different instrumental-analytical X-ray measuring means (not shown). The safety housing 1 surrounds a working chamber 2 inside the safety housing 1, in which the X-ray apparatus can be disposed. The safety housing 1 has a plurality of stationary protection elements 3*a*-3*c*, which are impermeable to X-ray radiation, e.g. lead-containing side walls 3*a*, ceiling plates 3*b* and floor plates 3*c*.

Towards the front, the working chamber 2 has an access 4 (FIGS. 1*a*-1*c*), which can be covered by door protection elements 5*a*, 5*b* (in the present case lead glass panes) that are impermeable to X-ray radiation. The door protection elements 5*a*, 5*b* belong to two doors 6*a*, 6*b*.

The doors 6*a*, 6*b* have two functions. Each door 6*a*, 6*b* has a (in the present case C-shaped) casement 7*a*, 7*b* which is pivotably disposed on a stationary main frame 9 of the safety housing 1 via hinges 8 (cf. pivot axes S). Each casement 7*a*, 7*b*, in turn, bears one sliding door 10*a*, 10*b*, which can be moved on the casements 7*a*, and 8*b*, respectively (cf. direction of movement V). Each sliding door 10*a*, 10*b* has a handle 11 that has a manually operable push button 12 of an operating element for actuating the latch.

FIG. 1*a* shows the inventive safety housing 1 with closed sliding doors 10*a*, 10*b* and closed casements 7*a*, 7*b*, as required during X-ray measurement for shielding the X-ray radiation that is released in the working chamber 2. In order to perform minor manipulations in the working chamber 2, e.g. change the sample, it is sufficient to only open the two sliding doors 10*a*, 10*b*, thereby opening approximately half of the width of the maximum access 4 (FIG. 1*b*). This requires only a relatively little amount of space on the left and right-hand side of the safety housing 1. For lager-scale manipulation, e.g. exchange of the X-ray apparatus in the working chamber 2, the casements 7*a*, 7*b* can be pivoted open, wherein the (largely) closed sliding doors 10*a*, 10*b* are also pivoted and the overall maximum access 4 is opened (FIG. 1*c*).

The door mechanism preferably permits movement of the sliding doors 10*a*, 10*b* only when the casements 7*a*, 7*b* are closed and vice versa, the casements 7*a*, 7*b* can only be pivoted when the sliding doors are (largely) closed.

In the illustrated embodiment, each door protection element 5*a*, 5*b* extends over the full width B and the full height H of the area of the access 4 that is covered by the associated door 6*a*, 6*b*.

Figure 2:
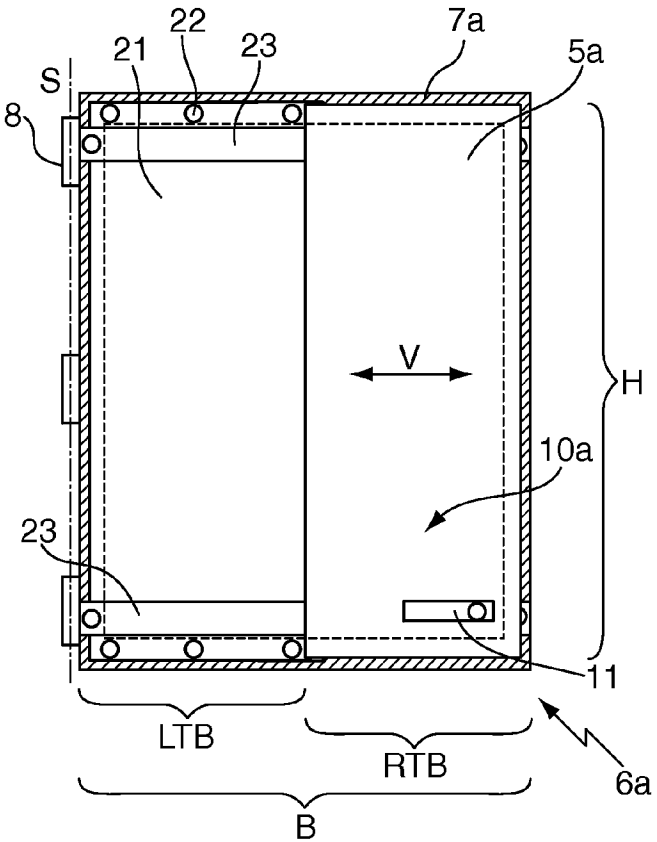
FIG. 2 shows a schematic view of a door for an inventive safety housing with a door protection element that is rigidly mounted to the casement.

FIG. 2 shows a schematic front view of a different design of a door 6*a* for an inventive safety housing.

The door 6*a* has a rectangular casement 7*a* (shown in hatched lines, the covered inner border is shown with dashed lines), which is mounted by hinges 8 to the main frame (not sown) of the safety housing and can be rotated about a vertical pivot axis S.

In this case, a door protection element 21 is rigidly mounted to the casement 7*a* with rivets 22. Two rails 23 are also mounted to the casement 7*a*, which extend over the entire width B of the door 6*a* and are used as a bearing for a sliding door 10*a*. The sliding door 10*a* can be moved on the rails 23 in the direction V. The sliding door 10*a* has a door protection element 5*a*, which can be moved with the sliding door 10*a*. The sliding door 10*a* can be handled via the handle 11.

In FIG. 2, the sliding door 10*a* is closed such that the door 6*a* with the two door protection elements 21, 5*a*, completely covers the access to the working chamber, disposed behind it, with respect to x-ray radiation, in particular, over the entire width B of the door 6*a* or the access. The rigid door protection element 21 thereby covers a left-hand partial area LTB and the door protection element 5*a* of the sliding door 10*a* covers a right-hand partial area RTB of the door 6*a* or the access. Each partial area LTB, RTB corresponds to approximately half the full width B, wherein there is a slight overlap. Both door protection elements 21, 5*a* extend over the full height H of the door 6*a* or the access located behind it.

When the sliding door 10*a* is moved to the left from the closed position, the access to the working chamber is opened in the right-hand partial area RTB. Towards this end, the sliding door 10*a* requires no space on the side of the door (e.g. on the left-hand side of the door) or in front of the door 6*a*, since the sliding door can be easily moved in front of the rigid door protection element 21. When full access via both partial areas RTB, LTB is required, the casement 7*a* can be pivoted open.

FIGS. 3*a*-3*d* schematically explain a door mechanism, in particular a latch mechanism, which can be used in accordance with the invention in an inventive safety housing. Different operating states are thereby schematically shown in cross section.

FIG. 3*a* shows in a first operating mode (sliding door function) an inventive door with a casement 7*a*, which is pivotably mounted by means of hinges (pivot joints) 8 to a main frame 9 (shown in dashed lines). A sliding door 10*a* is disposed (borne) on the casement 7*a*, which can be displaced in the direction V parallel to the casement 7*a*. An operating element 31 in a first (extended) position does thereby not impair the movement of the sliding door 10*a*. The sliding door 10*a* can be moved by a maximum path of displacement SW (in FIG. 3*a* stated for the right-hand end of the sliding door), which corresponds in this case to approximately half the width of the casement 7*a*. The path of displacement SW is limited to ensure the stability of the sliding door bearing and delimit the lateral space requirements (area of risk of collision).

The casement 7*a*, however, is locked. A latch 32, which is disposed on the casement 7*a* such that it can be displaced in a direction R, engages at its right end in a (schematically shown) lug 33 of the main frame 9 such that the casement 7*a* cannot be pivoted open.

FIG. 3*b* shows a first phase of switching over the operating modes. When the sliding door 10*a* is closed (i.e. the sliding door 10 is on the very right) the operating element 31 is inserted. The operating element 31 penetrates through the casement 7*a* in this second position and engages in a recess 32*a* of the latch 32 such that the movement of the latch 32 is coupled to the movement of the sliding door 10*a*.

FIG. 3*c* shows the second phase of switching over the operating modes. When the operating element 31 is inserted, the sliding door 10*a* including operating element 31 is slightly moved to the left by the amount EW (unlocking path) until the latch 32 meets the mechanical stop 34. The carried-along latch 32 is thereby removed from the lug 33, thereby unlocking the casement 7*a*. It must be noted that the unlocking path EW thereby amounts to approximately ⅕ of the maximum sliding path SW.

Figure 5A:
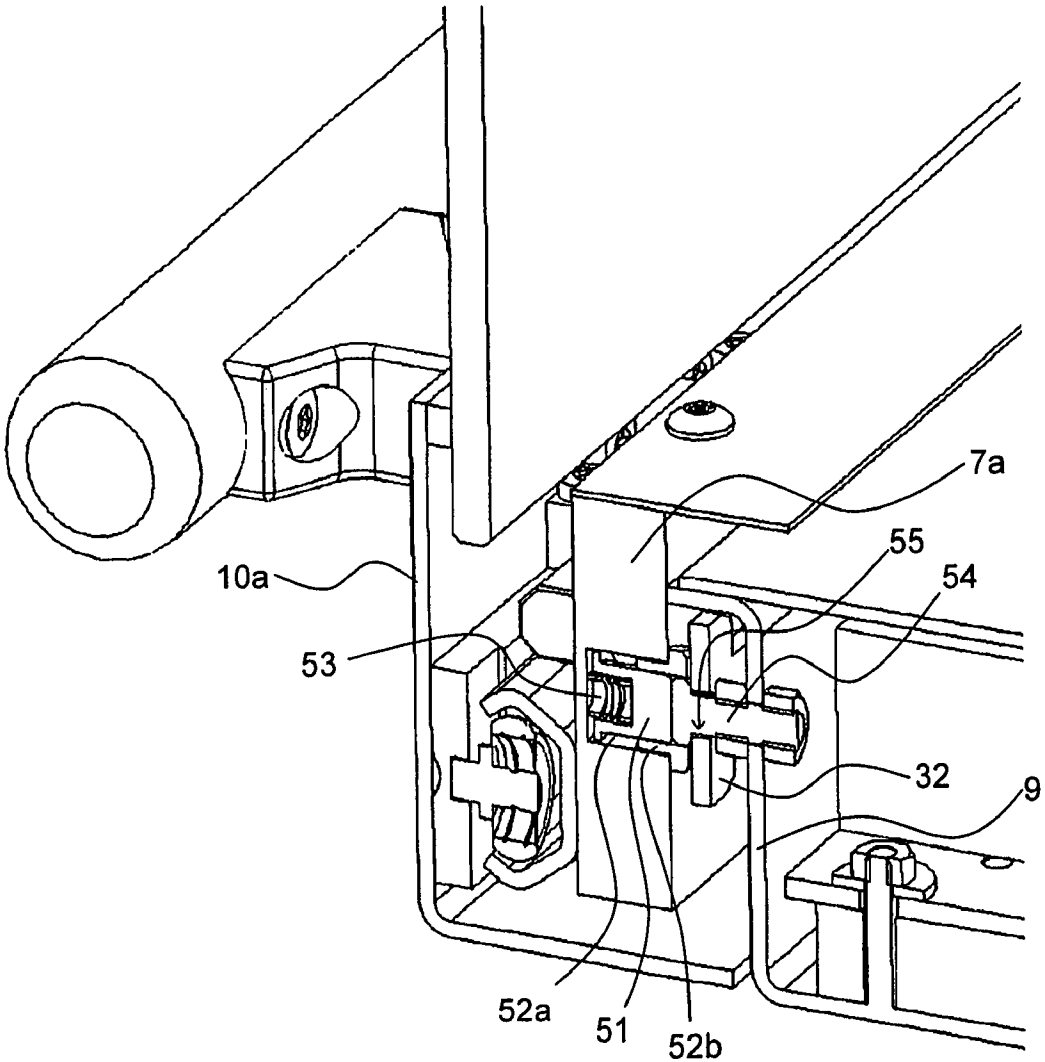
FIG. 5*a* shows a schematic view of a further locking mechanism of a door of an inventive safety housing with an unlocked locking element with closed casement.
Figure 5B:
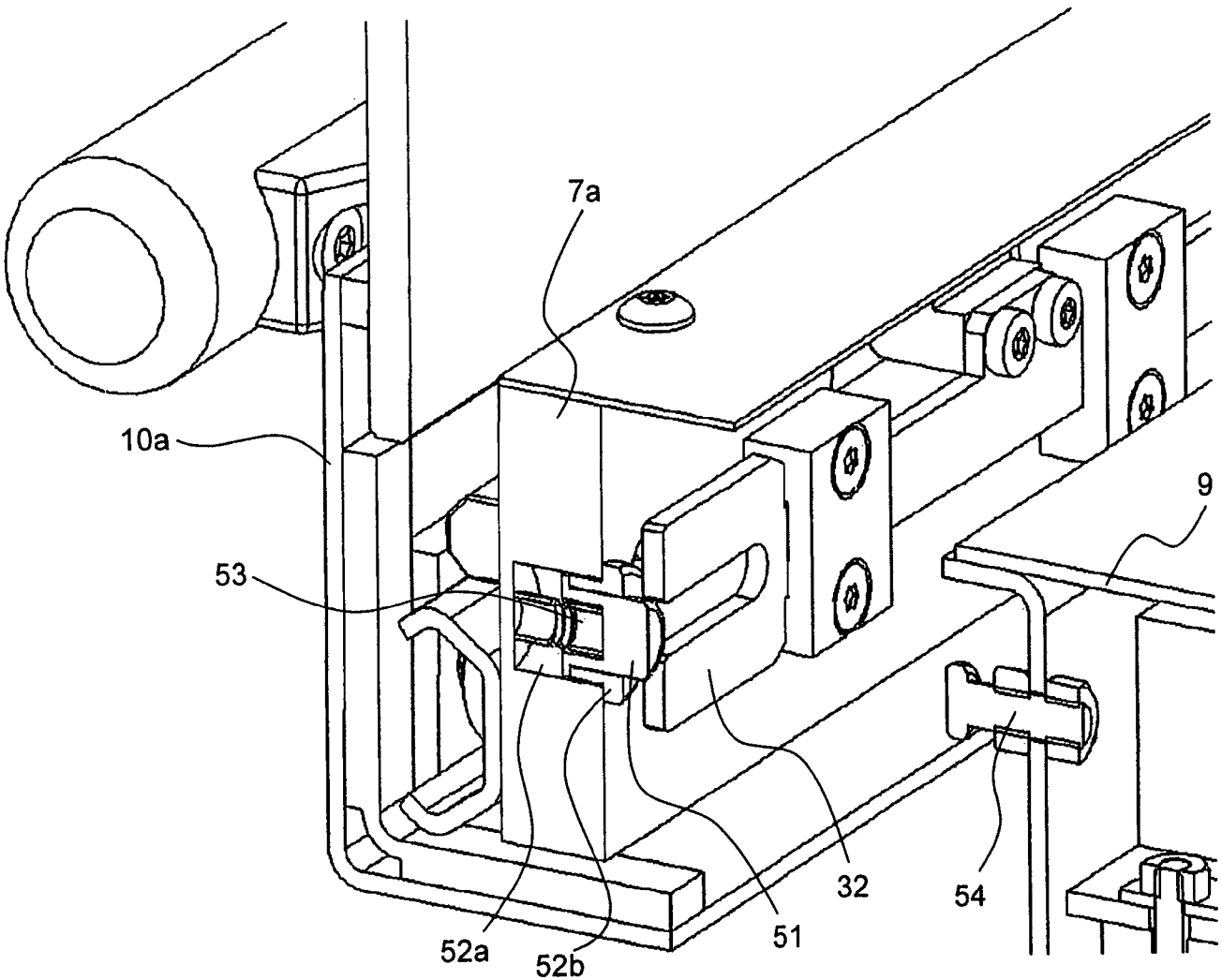
FIG. 5*b* shows the locking mechanism of FIG. 5*a*, in which the casement is opened and the locking element is in the locking position.

FIG. 3*d* shows the second operating mode (folding door function) of the door. The casement 7*a* can be rotated about the hinge 8. The operating element 31 thereby typically remains in the second position and the sliding door 10*a* is preferably locked in the movement position on the mechanical stop 34 when the casement 7*a* is opened (FIGS. 5*a*, 5*b* show a feasible realization thereof).

FIG. 3*e* shows an alternative inventive door mechanism similar to FIG. 3*a*. In this door mechanism, the latch 32 is not disposed on the casement 7*a* but on the main frame 9 such that it can be displaced in a direction R'. A rigid lug 33*a* is formed on the casement 7*a*, into which the latch 32 can engage in order to lock the casement 7*a* on the main frame 9. FIG. 3*e* shows the locked (and closed) state of the casement 7*a*. The operating element 31 is retracted (in the first position), such that the sliding door 10*a* can be moved in front of the casement in the direction V, wherein the directions V and R' extend parallel to each other.

Figure 4A:
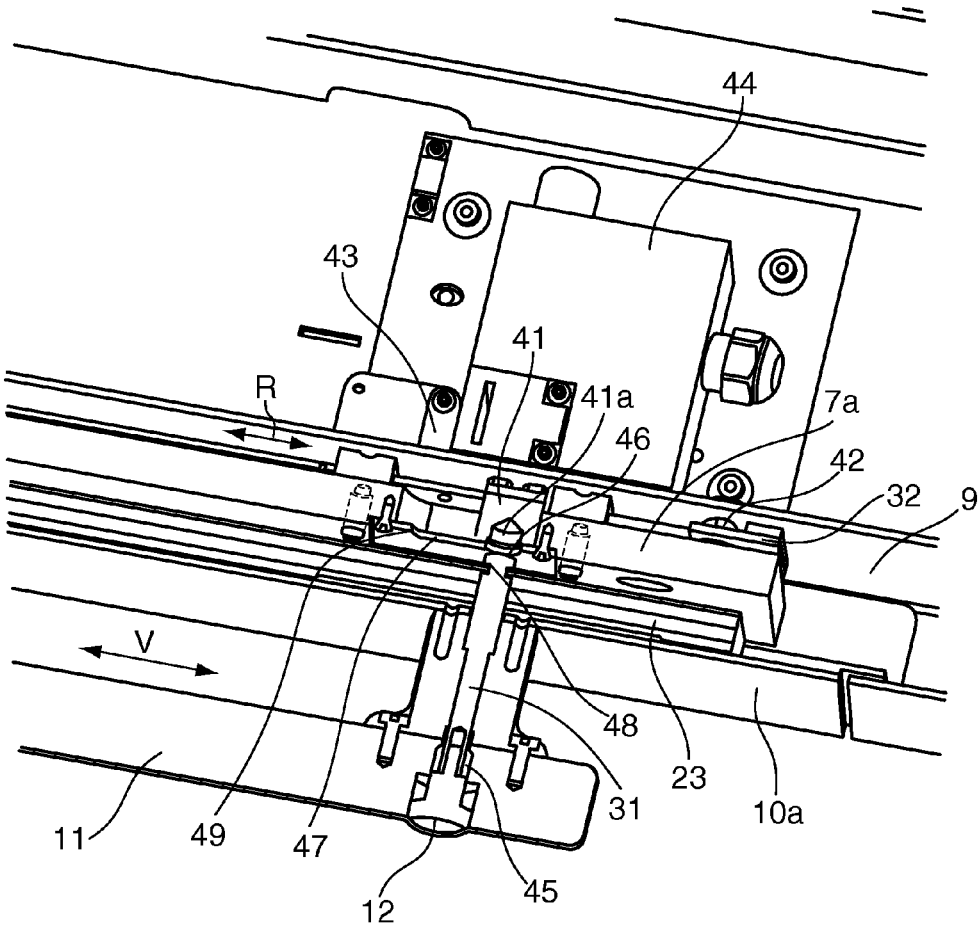
FIG. 4*a* shows a schematic sectional view of a locking mechanism of a door of an inventive safety housing in a first position of the operating element.
Figure 4B:
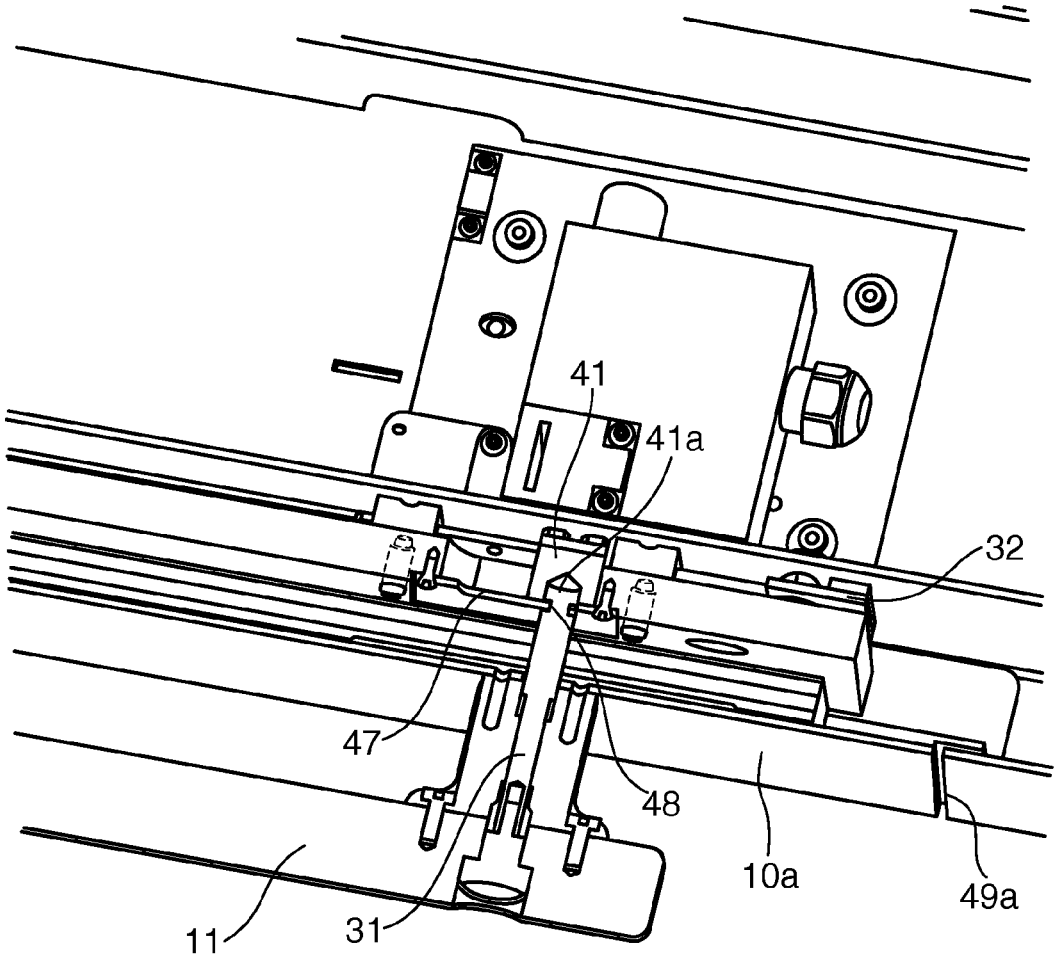
FIG. 4*b* shows the locking mechanism of FIG. 4*a* in a second position of the operating element with locked casement.
Figure 4C:
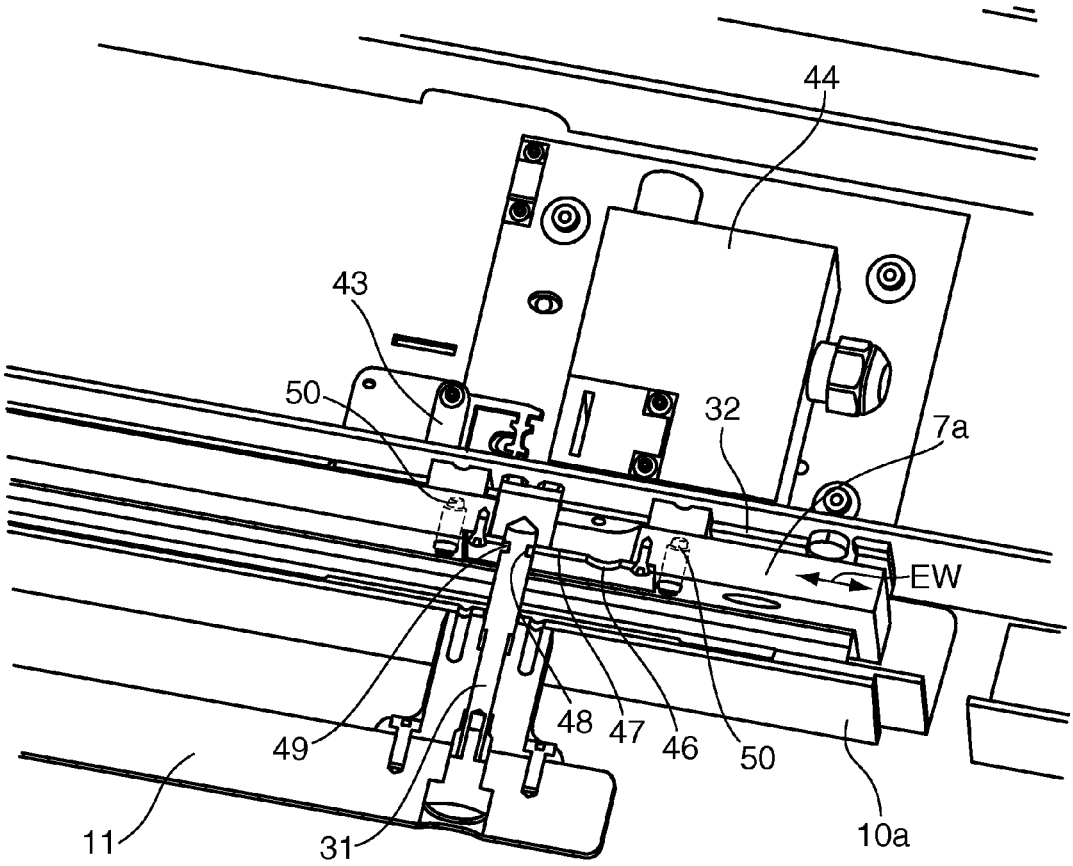
FIG. 4*c* shows the locking mechanism of FIG. 4*a* in a second position of the operating element with unlocked casement.

FIGS. 4*a* through 4*c* show the door locking mechanism of an inventive safety housing in greater detail.

Each section shows one sliding door 10*a*, to which a handle 11 with an inserted substantially pin-shaped operating element 31 (with push button 12) is mounted. The sliding door 10*a* is displaceably disposed on a casement 7*a* by means of a rail (linear guidance) 23. The casement 7*a* abuts a main frame 9 that is stationary during all door operations. A carrier 41 is disposed in the casement 7*a*, which can be displaced in a direction R. The carrier 41 is rigidly connected to a latch 32 which can engage behind a hook (only indicated by reference numeral 42) that is fixed to the main frame 9. The carrier 41 has a recess 41*a* for engagement of the operating element 31. An actuator 43 is moreover rigidly connected to the sliding door 10*a* and can engage in a safety module 44.

FIG. 4*a* initially shows the sliding door function. The operating element 31 is in a first position in which it does not engage in the recess 41*a*. The operating element 31 is thereby pretensioned into this first position by a pressure spring 45. The sliding door 10*a* can then be freely moved on the casement 7*a* in the direction V.

The latch 32 engages behind the hook 42, such that the casement 7*a* is locked on the main frame 9 and, in particular, cannot be pivoted open to the front.

In the position of the sliding door 10*a* shown in FIG. 4*a* (completely closed), the actuator 43 is inserted into the safety module 44. In this position, an X-ray experiment may be started and continued in the safety housing.

FIG. 4*b* illustrates the first step for switching over the operating mode. When the sliding door 10*a* is closed, the operating element 31 is pushed in against the spring force. The front end of the operating element 31 engages in this second position into the recess 41*a* of the carrier 41. A widening 46 of the elongated hole 47 is thereby penetrated, which is formed on the casement 7*a* (see FIG. 4*a*). A narrowing 48 on the operating element 31 is then at the position of the elongated hole 47. It must be noted that the elongated hole 47 only permits switching over of the operating element 31 from the first into the second position via the widening 46 when the sliding door 10*a* is completely closed (see FIG. 4*a*). The completely closed sliding door position is defined by a mechanical auxiliary stop 49*a*.

The engaging operating element 31 couples the motions of the sliding door 10*a* and the carrier 41 and thereby also of the latch 32. When the sliding door 10*a* is moved to the left with the operating element 31 in the second pushed-in position, the latch 32 is carried along by the carrier 41 such that the casement 7*a* is unlatched. The directions R and V are parallel.

FIG. 4*c* shows the door mechanism with the sliding door 10*a* moved to the left and retracted latch 32, i.e. with unlocked casement 7*a*. The narrowing 48 of the operating element 31 is surrounded by the elongated hole 47 and is supported on the left-hand side at the end of the elongated hole 47 as a mechanical stop 49 ("unlocked position of movement"). The mechanical stop 49 delimits the unlocking path EW of the sliding door 10*a* (it must be noted that as an alternative or additionally, the carrier 41 or the latch 32 could also be moved to a corresponding mechanical stop). Since the elongated hole 47 engages in the narrowing 48 (i.e. surrounds it tightly), the operating element 31 cannot move back from the second pushed-in position.

In the unlocked position of movement of the sliding door 10*a*, the actuator (the safety bracket) 43 is completely removed from the safety module 44. For this reason, the actuator 43 no longer obstructs opening of the casement 7*a*.

The sliding door 10*a* is fixed in the position of movement abutting the mechanical stop 49 by a blocking mechanism. In the illustrated example, the blocking mechanism has two resilient balls 50 that are formed on the casement 7*a* and engage in depressions (not shown in detail) on the latch 32. In order to move the sliding door 10*a* (and thereby also the latch 42) with respect to the casement 7*a* out of the unlocked position of movement, the mechanical resistance of the resilient balls (pressure balls) 50 must be overcome. This secures handling of the handle 11 for opening and closing the casement 7*a*, in particular when the casement 7*a* is open.

After pivoting the casement, e.g. for exchanging an X-ray apparatus in the working chamber of the safety housing, the casement 7*a* is applied again to the main frame 9 (is closed), and the sliding door 10*a* is moved from its unlocked position of movement on the left-hand side mechanical stop 49 back to the locked (completely closed) position of movement on the right-hand side mechanical auxiliary stop 49*a*. The latch 32 is thereby carried along, which finally locks again the casement 7*a* on the main frame 9. In the completely closed position of the sliding door 10*a*, the operating element 31 moves back into the first position due to the pressure spring 45, and thereby into the sliding door mode.

Securing the unlocked position of movement of the sliding door in the folding door mode may alternatively or additionally not only be impeded but also be mechanically locked by a locking mechanism, which is illustrated in FIGS. 5*a* and 5*b*. These show a perspective, approximately front-side view of an inventive door mechanism similar to the door mechanism shown in FIGS. 4*a*-4*c*. FIG. 5*a* shows a closed and locked casement, while FIG. 5*b* shows a pivoted-open unlocked casement.

The casement 7*a* has an approximately cylindrical locking element 51, which is disposed in a depression 52*a* and extends through a bearing bushing (guiding bushing) 52*b*. The bearing bushing 52*b* is glued into the depression 52*a* or fastened in a different mechanical fashion (e.g. screwed). The locking element 51 is pretensioned by a pressure spring (not shown in detail) at an inside 53 of the locking element 51 into a position projecting towards the main frame 9 (see FIG. 5*b*). In this position, the locking element 51 blocks movement of the latch 32. The left-hand side of the latch 32 contacts (in FIG. 5*b*) the locking element. This also blocks movement of the sliding door 10*a* (which is hinged to the latch 32 with the operating element and the carrier in FIG. 5*b*) towards the left-hand side (towards the locked position). The latch 32 is then fixed in the unlocked position. The sliding door 10*a* remains held in an unlocked position of movement on a mechanical stop (not shown in FIG. 5*b*).

When the casement is closed (i.e. applied to the main frame 9, see FIG. 5*a*), the locking element 51 is pressed into the depression 52*a* by a counter means (guiding bolt) 54 that is rigidly formed on the main frame 9. The locking element 51 is then no longer in the path of movement of the latch 32. There is only a narrowing 55 of the counter means 54 in the area of the path of movement of the latch 32, which can, however, be surrounded by the latch 32 that is approximately C-shaped in its end area, such that the counter means 54 does not block the path of motion of the latch 32. When the casement 7*a* is closed, the latch 32 can be actuated by the sliding door 10*a* and, in particular, be locked (i.e. be moved to the left in FIG. 5*a*). In FIG. 5*a*, the latch is in the locked position, wherein the left-hand bracket-like part of the latch 32 is not shown for reasons of simplicity. The thickened, free end of the counter means 54 thereby acts as engagement hook for the latch 32 in order to fix the casement 7*a* to the main frame 9.

In summary, the present invention describes a safety housing for an X-ray apparatus that releases dangerous X-rays, the access to which is provided with a door with a double frame system which permits both a pivoting function and also a sliding function. This double function saves space in front of the access during normal operation of the X-ray apparatus, e.g. for changing the sample. Both functions can be operated via one single operating element via the sliding door, wherein a slight movement of the sliding door in a second position of the operating element is used to operate a latch (or a latch system with several individual latches). This yields high operational comfort and simple construction. In particular, no external tools or auxiliary means are required for switching between the functions. When the sliding door function is activated, the folding door function is mechanically locked and when the folding door function is activated, the sliding door is mechanically locked. The access can be secured by one single safety module.

I claim:

1. A safety housing for a X-ray apparatus, the housing comprising:

a main housing frame;

means, cooperating with said main housing frame, for defining a working chamber having an access opening, said working chamber structured and dimensioned to accommodate an X-ray apparatus, said working chamber defining means comprising shields, lead-containing walls and/or lead glass panes, which are impermeable to X-rays;

at least one multiple function door for opening and closing said access opening to said working chamber, said multiple function door comprising at least one sliding door having a shielding element or lead glass pane which is impermeable to X-ray radiation and which completely covers said access opening to said working chamber;

a casement cooperating with and supporting said multiple function door;

means for pivoting said casement relative to said main frame about a pivot axis;

means for displacing said sliding door along said casement in a sliding direction; and an operating element, said operating element having a first mode in which said sliding door is enabled for sliding along said casement and a second operating mode in which said casement is enabled for pivoting relative said main frame.

2. The safety housing of claim 1, wherein said access opening to said working chamber is completely covered by said shielding element of said sliding door.

3. The safety housing of claim 2, wherein said sliding door comprises exactly one shielding element.

4. The safety housing of claim 1, where said shielding element of said sliding door extends perpendicularly to said sliding direction of said sliding door to span an entire height of said access opening.

5. The safety housing of claim 1, wherein said multiple function door comprises at least one door protection element, rigidly mounted to said casement and, when said casement is closed and said sliding door is closed, said shielding element of said sliding door extending over a first partial area of said access opening in a direction parallel to said sliding direction, said door protection element which is rigidly mounted to said casement extending over a second partial area of said access opening in a direction parallel to said sliding direction, wherein said first plus said second partial areas cover an entire width of said access opening that closed by said multiple function door.

6. The safety housing of claim 5, wherein said first and said second partial areas overlap.

7. The safety housing of claim 5, wherein, when said casement is closed and said sliding door is closed, said first partial area extends approximately over half a width of said access opening and parallel to said sliding direction.

8. The safety housing of claim 1, wherein, when said sliding door is closed and said casement is closed, said shielding element of said sliding door covers said access opening to said working chamber in a border region of said access opening that is remote from a pivot of said casing, wherein said sliding door is displaced from a closed position thereof towards said pivot axis.

9. The safety housing of claim 1, further comprising a latch for locking and unlocking said casement in a closed state thereof with respect to said main frame, wherein said operating element is disposed on said sliding door, said operating element being moved together with said sliding door and switched between a first position and a second position, wherein, in said first position of said operating element, said operating element does not impair movement of said sliding door along said casement and movement of said sliding door does not influence a latch position, and wherein, in said second position of said operating element, said operating element engages in said latch or a carrier that is rigidly connected or hinged to said latch such that said latch is operated when said casement is closed by moving said sliding door in said second position of the operating element.

10. The safety housing of claim 9, wherein, in said second position of said operating element, a latch position associated with a closed position of said sliding door locks said casement and a latch position associated with a moved sliding door releases said casement.

11. The safety housing of claim 10, wherein a region of movement of said sliding door away from said closed position in said second position of said operating element is limited by a mechanical stop on an unlocking path EW which is shorter than a feasible sliding path SW of said sliding door In said first position of said operating element.

12. The safety housing of claim 11, wherein EW≦0.2 SW or EW≦5 cm.

13. The safety housing of claim 11, wherein said multiple function door comprises a locking mechanism which blocks movement of said sliding door out of a position of movement of said sliding door at said mechanical stop when said casement is not closed and when said operating element is located in said second position, wherein a movable locking element is provided on said casement which is pretensioned by a force of a spring into a locking position in which it blocks a path of movement of said operating element or said latch or said carrier in said second position, and which is pushed out of the path of movement of said operating element or said latch or said carrier in said second position when said casement is closed through interaction with a counter means that is rigidly formed on said main frame.

14. The safety housing of claim 11, further comprising means for blocking a position of movement of said sliding door at said mechanical stop.

15. The safety housing of claim 14, wherein said blocking means comprises a resilient ball in said casement which engages in a depression on said latch.

16. The safety housing of claim 14, wherein said blocking means is activated by a third position of said operating element in which a holding element of said casement blocks movement of said operating element, wherein said operating element is driven by a force of a spring from said second position into said third position, said third position being disposed between said first position and said second position.

17. The safety housing of claim 1, wherein said casement comprises a guidance which holds said operating element in said second position when said sliding door is moved out of a closed position thereof in said second position of said operating element and which only permits changing over between said first and said second positions when said sliding door is closed.

18. The safety housing of claim 17, wherein said guidance has an elongated hole through which said operating element is guided at a operating element narrowing, wherein said elongated hole has a widening at which said operating element is switched between said first and said second positions when said sliding door is closed.

19. The safety housing of claim 9, wherein said operating element comprises a pin that is retracted and extended and which is pretensioned by a spring force into a retracted position corresponding to said first position of said operating element and which is pushed manually into an extended position corresponding to said second position of said operating element.

20. The safety housing of claim 9, wherein said latch is disposed on said casement such that it is displaced In a direction parallel to said sliding direction.

21. The safety housing of claim 9, wherein said latch is disposed on said main frame such that it is displaced in a direction which is parallel to said sliding direction when said casement is closed.

22. The safety housing of claim 9, further comprising an electronic safety module disposed on said main frame to monitor closure of said access opening to said working chamber by said multiple function door during operation of an X-ray apparatus in said working chamber, said X-ray apparatus releasing X-ray radiation during operation thereof, wherein said safety module ensures a presence of an actuator in said safety module during operation of the X-ray apparatus, the actuator being rigidly mounted to said sliding door, wherein said safety module is designed in such a fashion that said actuator is inserted into and removed from said safety module only when said casement is closed by displacing said sliding door, wherein a position of said actuator within said safety module corresponds to a closed position of said sliding door.

23. The safety housing of claim 9, wherein said sliding direction in which said sliding door is moved with respect to said casement, extends perpendicularly to said pivot axis.

24. The safety housing of claim 1, wherein said casement is C-shaped, wherein an open side of said C-shaped casing faces away from said pivot axis.

25. The safety housing of claim 1, wherein the housing comprises two adjacent multiple function doors, wherein said multiple function doors form two opposite wings of a double door, with shielding elements of said two multiple function doors overlapping.

26. The safety housing of claim 1, wherein said operating element is disposed, structured and dimensioned such that said first operating mode blocks said second operating mode and said second operating mode blocks said first operating mode.

* * * * *